US010670347B2

(12) United States Patent
Fetvedt

(10) Patent No.: US 10,670,347 B2
(45) Date of Patent: Jun. 2, 2020

(54) HEAT EXCHANGER COMPRISING ONE OR MORE PLATE ASSEMBLIES WITH A PLURALITY OF INTERCONNECTED CHANNELS AND RELATED METHOD

(71) Applicant: 8 Rivers Capital, LLC, Durham, NC (US)

(72) Inventor: Jeremy Eron Fetvedt, Raleigh, NC (US)

(73) Assignee: 8 Rivers Capital, LLC, Durham, NC (US)

( * ) Notice: Subject to any disclaimer, the term of this patent is extended or adjusted under 35 U.S.C. 154(b) by 0 days.

(21) Appl. No.: 15/887,760

(22) Filed: Feb. 2, 2018

(65) Prior Publication Data

US 2018/0156543 A1 Jun. 7, 2018

Related U.S. Application Data

(62) Division of application No. 13/553,144, filed on Jul. 19, 2012, now Pat. No. 9,921,000.

(Continued)

(51) Int. Cl.
*F28D 9/00* (2006.01)
*F28F 3/04* (2006.01)

(Continued)

(52) U.S. Cl.
CPC ..... *F28D 9/0062* (2013.01); *F28F 3/04* (2013.01); *F28F 3/048* (2013.01); *F28F 3/06* (2013.01);

(Continued)

(58) Field of Classification Search
CPC . F28D 9/0062; F28F 3/04; F28F 3/048; F28F 3/06; F28F 3/12; F28F 19/00; F28F 2250/04

(Continued)

(56) References Cited

U.S. PATENT DOCUMENTS 3,476,179 A 11/1969 Meister et al.
4,516,632 A 5/1985 Swift et al.

(Continued)

FOREIGN PATENT DOCUMENTS

| | | |
|---|---|---|
| DE | 198 18 839 | 10/1999 |
| EP | 2 072 101 | 6/2009 |
| WO | WO 90/13784 | 11/1990 |

OTHER PUBLICATIONS

International Search Report and Written Opinion of the International Searching Authority issued in corresponding International Application No. PCT/US2012/047367, dated Jan. 18, 2013.

(Continued)

*Primary Examiner* — Tho V Duong
(74) *Attorney, Agent, or Firm* — Womble Bond Dickinson (US) LLP

(57) ABSTRACT

Plate assemblies configured for use in heat exchangers are provided. The plate assemblies may include one or more plates defining an inlet end, an outlet end, and flow channels configured to receive a flow of fluid from the inlet end and direct the fluid to the outlet end. The flow channels may be defined by protrusions, grooves, and/or orifices defined in flow plates, and spacer plates may separate the plate assemblies from one another. The flow channels may be interconnected such that for each of a plurality of intermediate positions along the flow channels, a plurality of flow paths are defined. Thus, in an instance in which a blockage occurs in one of the flow channels, flow may be prevented through only a portion of the flow channel.

5 Claims, 5 Drawing Sheets

Related U.S. Application Data

(60) Provisional application No. 61/510,829, filed on Jul. 22, 2011.

(51) Int. Cl.
*F28F 3/06* (2006.01)
*F28F 3/12* (2006.01)
*F28F 19/00* (2006.01)

(52) U.S. Cl.
CPC ..... *F28F 3/12* (2013.01); *F28F 19/00* (2013.01); *F28F 2250/04* (2013.01)

(58) Field of Classification Search
USPC ..... 165/168
See application file for complete search history.

(56) References Cited

U.S. PATENT DOCUMENTS 4,624,305 A * 11/1986 Rojey ..... F28F 3/086 165/165
5,193,611 A * 3/1993 Hesselgreaves ..... F28F 3/02 165/165
5,655,600 A * 8/1997 Dewar ..... F28D 9/0062 165/166
5,845,399 A 12/1998 Dewar et al.
5,857,517 A 1/1999 Grenier et al.
6,014,312 A * 1/2000 Schulz-Harder ..... F28F 3/086 165/80.4
6,167,952 B1 1/2001 Downing
6,309,773 B1 10/2001 Rock
6,510,894 B1 1/2003 Watton et al.
6,634,421 B2 * 10/2003 Ognibene ..... F28F 3/02 165/164
6,736,201 B2 5/2004 Watton et al.
6,968,892 B1 11/2005 Symonds
7,584,781 B2 * 9/2009 Lai ..... F28F 3/086 165/166
2007/0068663 A1 * 3/2007 Thomer ..... F28D 7/106 165/164
2007/0084593 A1 4/2007 Besant et al.
2008/0030194 A1 2/2008 Gromoll et al.
2009/0294113 A1 12/2009 Cha et al.
2011/0179799 A1 7/2011 Allam et al.
2012/0080166 A1 * 4/2012 Cheng ..... F28F 3/086 165/67

OTHER PUBLICATIONS

Chart Energy & Chemicals, Inc.; Brazed Aluminum Heat Exchangers Information Brochure; http://www.chartenergyandchemicals.com/pdffiles/BrazedAluminumHeatExchangers.pdf site visited Aug. 15, 2012.
Chart Energy & Chemicals, Inc.; Compact Heat Exchange Reactors Information Brochure; http://www.chartenergyandchemicals.com/pdffiles/Compact%20Heat%20Exchange%20Reactors.pdf site visited Aug. 15, 2012.
Heatric; Compact Diffusion-Bonded Heat Exchangers Information Brochure; http://www.heatric.com/hres/Heatric%20standard%20brochure.

* cited by examiner 411
400
408
402
404
406
412
414A
415A
409
414B
415B 411
406
418E
418D
414B
418C
406
408
400
414A
418B
404
418A
416
402
412
409

414B
415B
404
402
408
409
412
415A
414A
400

HEAT EXCHANGER COMPRISING ONE OR MORE PLATE ASSEMBLIES WITH A PLURALITY OF INTERCONNECTED CHANNELS AND RELATED METHOD

CROSS-REFERENCE TO RELATED APPLICATIONS

This application is a divisional of U.S. application Ser. No. 13/553,144, filed Jul. 19, 2012, which claims the benefit of U.S. Provisional Application No. 61/510,829, filed Jul. 22, 2011, both of which are entirely incorporated herein by reference.

FIELD OF THE INVENTION

The present disclosure relates to embodiments of heat exchangers. The heat exchangers may include features configured to reduce the effect of blockages in the heat exchangers.

BACKGROUND

Heat exchangers may be employed to exchange heat between two or more fluids. One example embodiment of a heat exchanger is a plate heat exchanger. Plate heat exchangers may employ a plurality of plates to transfer heat between first and second fluids. In this regard, the plates may be sandwiched together to form plate assemblies that may include apertures or groves therein that define flow channels through which one of the fluids may flow. The plates may be assembled in a manner such that the plate assemblies alternate the fluid carried therein and thereby the first fluid may travel through a plate assembly that may be beside (or sandwiched between) one or more plate assemblies through which the second fluid travels. Accordingly, the plates that separate the fluids may function to transfer heat between the two fluids. The plates may be configured to define relatively large surface areas such that fluid transfer between the fluids is improved.

One example embodiment of a plate assembly is illustrated in FIGS. 1A-C. This plate assembly may be included in heat exchangers manufactured by CHART INDUSTRIES of Garfield Heights, Ohio. The plate assembly 100 may include first 102 and second 104 flow plates that are sandwiched between spacer plates 106, 108. The spacer plates 106, 108 separate the plate assembly 100 from adjacent plate assemblies as discussed above. The flow plates 102, 104 may function to create flow channels through which a fluid may flow. As illustrated in FIG. 1C, the plates may be configured to create a turbulent flow path 110 through each of the flow channels, which may assist in heat transfer by slowing the flow of the fluid therethrough. The flow channels may be defined by a plurality of orifices 102A, 104A which are offset from one another and cause the flow path 110 to be serpentine.

A second example embodiment of a plate assembly is illustrated in FIGS. 2A and 2B. This plate assembly may be included in heat exchangers manufactured by HEATRIC, of Houston, Tex. As illustrated, the plate assembly 200 includes a flow plate 202 and a spacer plate 206. The flow plate 202 includes grooves 202A defined therein, which each define flow channels through which fluid flows along a turbulent flow path 210, as illustrated in FIG. 2B. Since the grooves 202A do not extend all the way through the flow plate 202, the flow plate functions as a second spacer plate with the grooves defining flow channels between the flow plate and the spacer plate 206.

Accordingly, prior art embodiments of heat exchangers may be designed to provide transfer of heat between fluids by causing turbulent flow paths for fluids between plates defining relatively large surface areas. As seen by the foregoing, however, known plate heat exchangers typically include multiple flow paths that define individual runs along the heat exchanger from the inlet to the outlet such that the individual runs have no fluid connection one with another between the inlet and the outlet. In this configuration, a blockage of an individual run prevents the blocked run from participating in heat exchange along its entire length and thus reduces heat exchange capacity of the overall device by the fraction of the area encompassed by the run. Since known heat exchangers can suffer from this and other limitations that may be addressed by the present disclosure, there remains a need in the art for improved heat exchangers.

SUMMARY OF THE DISCLOSURE

In one aspect the present disclosure provides plate assemblies that may be employed in heat exchangers. The plate assemblies may include a plurality of plates defining an inlet end, an outlet end, and a plurality of flow channels configured to receive a flow of fluid from the inlet end and direct the fluid to the outlet end. The flow channels may be interconnected such that for each of a plurality of intermediate positions along the flow channels, a plurality of flow paths are defined.

In one embodiment the plates may comprise a flow plate and a spacer plate. The flow channels are defined between a plurality of protrusions that are separated by a plurality of grooves. The protrusions may define a parallelogram shape. The grooves and the protrusions may be defined by the flow plate.

In another embodiment the plates may further comprise a second flow plate and a second spacer plate. The flow plate and the second flow plate may each comprise a plurality of protrusions and a plurality of orifices that collectively define the flow channels. The orifices of the flow plate may partially overlap with the orifices of the second flow plate. Further, the protrusions may each comprise a handle portion and three prongs extending therefrom. The protrusions may be interconnected in the flow plate and in the second flow plate. The handle portion of one of the protrusions may define one of the prongs of an adjacent one of the protrusions. For example, the handle portion of one of the protrusions may define a center one of the prongs of the adjacent one of the protrusions. The protrusions of the flow plate and the protrusions of the second flow plate may be oppositely disposed such that the handle portion of the protrusions of the flow plate point in an opposite direction relative to the handle portion of the protrusions of the second flow plate.

In an additional aspect a method for resisting blockage in a heat exchanger is provided. The method may include directing a fluid through an inlet end of a heat exchanger comprising a plurality of plates. Further, the method may include directing the fluid through a plurality of flow channels that are interconnected such that for each of a plurality of intermediate positions along the flow channels, a plurality of flow paths for the fluid are defined. The method may additionally include directing the fluid to an outlet end of the plates.

In one embodiment of the method, directing the fluid through the flow channels may comprise dividing the fluid into the flow paths with a plurality of protrusions. Further, directing the fluid through the flow channels may comprise directing the fluid between a flow plate and a spacer plate. Directing the fluid through the flow channels may also comprise directing the fluid through a plurality of partially overlapping orifices defined in a first flow plate and a second flow plate. The method may additionally include retaining the fluid between a first spacer plate and a second spacer plate. The method may further comprise receiving the fluid from a combustor. In some embodiments the fluid may comprise a particulate component.

Regardless of the particular implementation of the apparatus and the method, by defining multiple flow paths at each of a plurality of intermediate positions along a flow channel, the effects of blockages may be mitigated such that each blockage may only affect a small portion of the flow channel in which the blockage occurs.

BRIEF DESCRIPTION OF THE DRAWINGS

In order to assist the understanding of embodiments of the disclosure, reference will now be made to the appended drawings, which are not necessarily drawn to scale. The drawings are exemplary only, and should not be construed as limiting the disclosure.

DETAILED DESCRIPTION OF THE DISCLOSURE

Figure 1A:
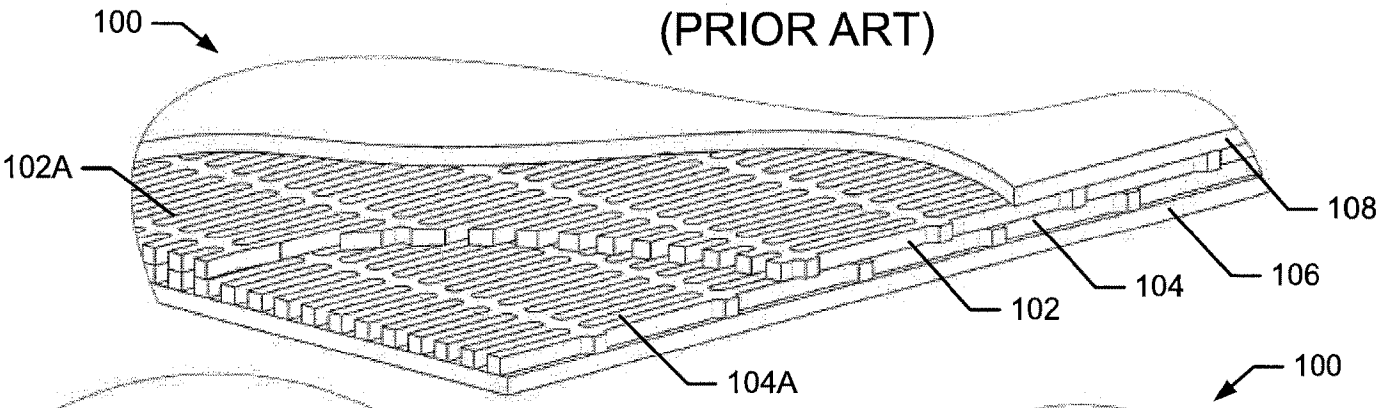
FIG. 1A (PRIOR ART)
FIG. 1A illustrates a partially cutaway perspective view through a prior art embodiment of a plate assembly comprising flow plates including orifices that define a plurality of segregated flow paths.

The present disclosure now will be described more fully hereinafter with reference to the accompanying drawings. The disclosure may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural references unless the context clearly dictates otherwise.

The present disclosure relates to heat exchangers. Existing heat exchangers may theoretically provide relatively efficient heat transfer. However, in practice the heat exchangers may suffer from problems that may reduce the heat transfer efficiency thereof. In this regard, existing embodiments of heat exchangers may suffer from clogs that block the flow channels through which the fluid therein is intended to travel.

By way of example, combustion of carbonaceous fuel for various uses, including but not limited to power production, may be carried out according to a system or method incorporating the use of an associated circulating fluid (such as a carbon dioxide ($CO_2$) circulating fluid). Such systems and methods can comprise a combustor that operates at very high temperatures (e.g., in the range of about 1,600° C. to about 3,300° C., or even greater), and the presence of the circulating fluid can function to moderate the temperature of a fluid stream exiting the combustor so that the fluid stream can be utilized in energy transfer for power production. The combustion product stream can be expanded across at least one turbine to generate power. The expanded gas stream then can be cooled to remove the desired components from the stream, and heat withdrawn from the expanded gas stream can be used to heat the $CO_2$ circulating fluid that is recycled back to the combustor. Preferably, the $CO_2$ circulating fluid stream can be pressurized prior to recycling through the combustor. Exemplary power production systems and methods that may be used for the initial combustion process are described in U.S. Patent Application Publication No. 2011/0179799, the disclosure of which is incorporated herein by reference in its entirety. Cooling of a combustion product stream (with or without a preceding expansion) can be carried out using one or more heat exchangers.

Thus, heat exchangers, including those disclosed herein, may be employed, for example, in the heat exchange operations associated with combustion of a carbonaceous fuel as described above. In particular, heat exchangers may be employed to exchange heat from combustion products to heat other fluids. However, combustion products may include components (e.g., particulate components) that could clog a heat exchanger. Likewise, heat exchangers may find use in a variety of other industries generally, or systems or methods specifically, wherein heat exchange capacity or efficiency may be affected if a portion of the heat exchanger becomes clogged, fouled, or otherwise obstructed.

Figure 1C:
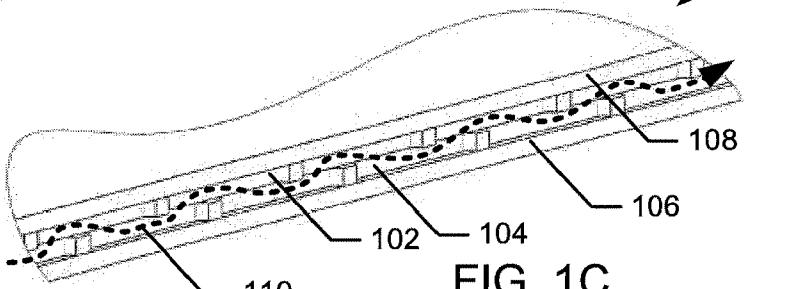
FIG. 1C (PRIOR ART)
FIG. 1C illustrates a side sectional view through the plate assembly of FIG. 1A.
Figure 1B:
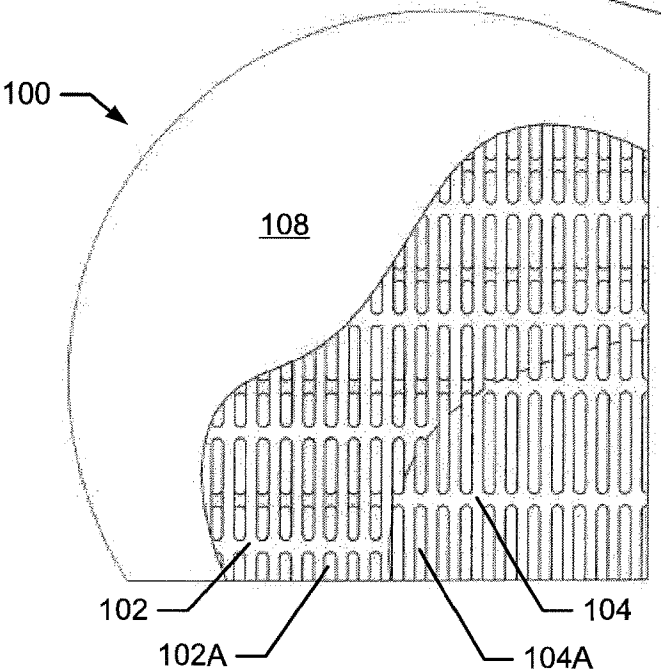
FIG. 1B (PRIOR ART)
FIG. 1B illustrates a top partially cutaway view through the plate assembly of FIG. 1A.
Figure 2A:
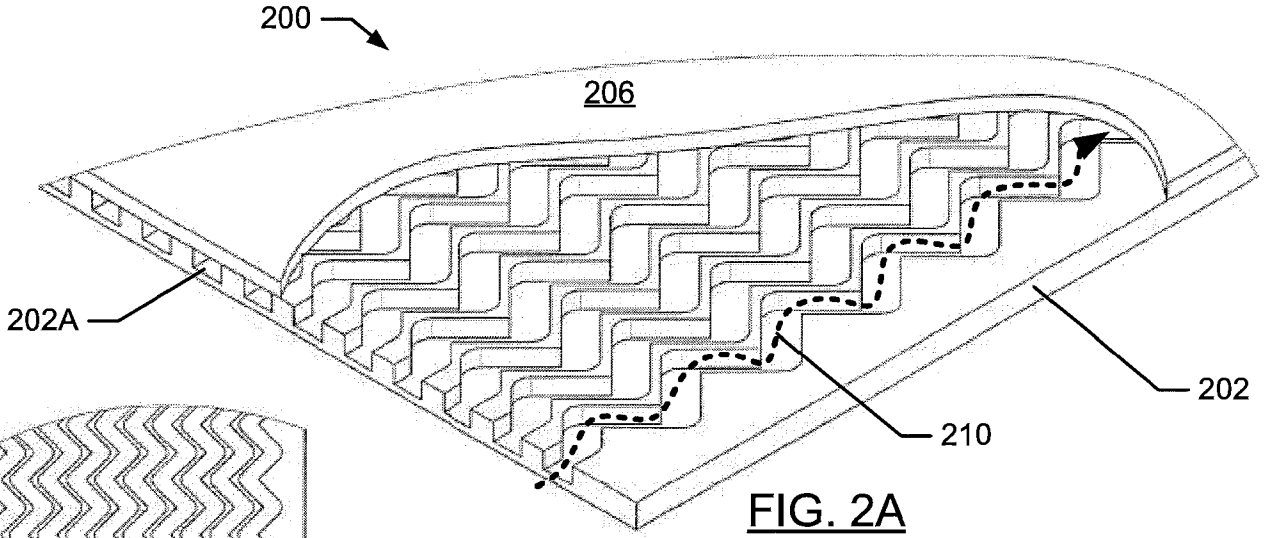
FIG. 2A (PRIOR ART)
FIG. 2A illustrates a partially cutaway perspective view through a prior art embodiment of a plate assembly comprising a flow plate including flow channels therein that define a plurality of segregated flow paths.
Figure 2B:
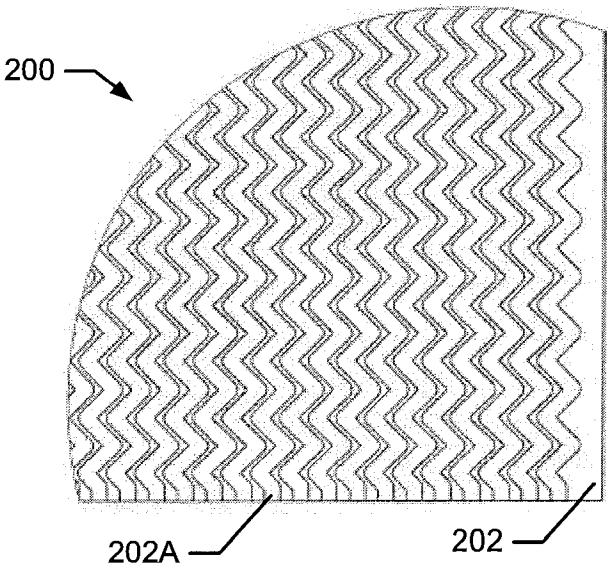
FIG. 2B (PRIOR ART)
FIG. 2B illustrates a top partially cutaway view through the plate assembly of FIG. 2A.

In prior art embodiments of heat exchangers, as already noted above, the flow channels may be segregated from one another and each flow channel may offer only a single flow path that is independent from any further flow paths within the heat exchanger. As a result of this configuration, a clog in a flow channel may partially or completely block the flow channel and cause the entire flow channel to lose at least a portion of its flow capacity and up to 100% of its flow capacity. For example, in the prior art plate assemblies 100, 200 illustrated in FIGS. 1 and 2, a blockage in one of the orifices 102A, 104A or a blockage in one of the channels 202A may cause the flow path 110, 210 associated with the flow channel in which the blockage occurs to be blocked. Since each flow channel offers only one flow path 110, 210, the entire flow channel may essentially cease to assist in heat transfer, regardless of where the blockage occurs along the flow channel. Thus, for example, in a heat exchanger comprising one hundred flow channels, blockage of one flow channel may result in approximately a one percent decrease in heat transfer efficiency.

Figure 3A:
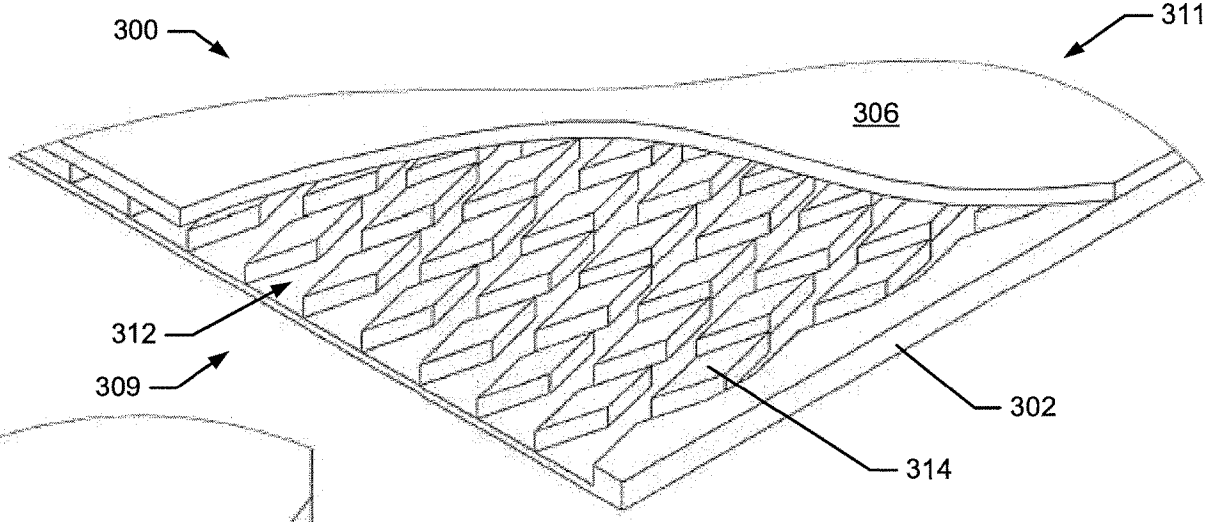
FIG. 3A illustrates a partially cutaway perspective through a plate assembly including a flow plate with grooves and protrusions defined therein that create flow channels with multiple flow paths at intermediate positions along the flow channels, according to one example embodiment of the present disclosure.
Figure 3B:
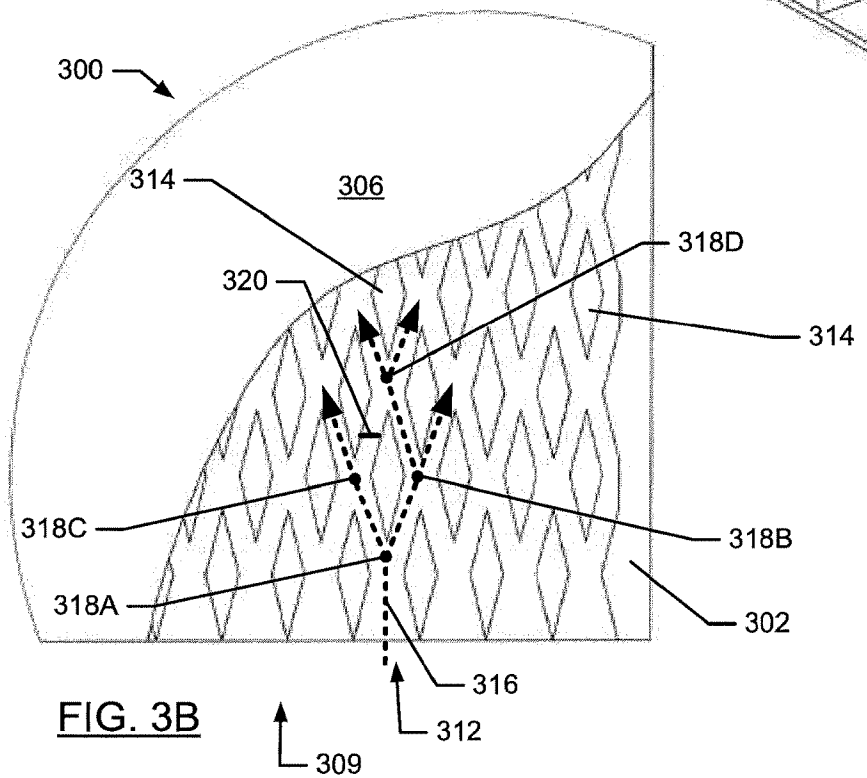
FIG. 3B illustrates a top partially cutaway view through the plate assembly of FIG. 3A.

Thus, there is herein provided embodiments of heat exchangers configured to mitigate the effect of blockages therein. In this regard, FIGS. 3A and 3B illustrate a plate assembly of a heat exchanger according to one embodiment of the present disclosure. As illustrated in FIGS. 3A and 3B, the plate assembly 300 may include a flow plate 302 and a spacer plate 306. The flow plate 302 may include grooves defined therein, which define flow channels 312 and protrusions 314. The flow channels 312 may be defined between an inlet end 309 and an outlet end 311. The grooves may be defined by etching in some embodiments. Since the grooves do not extend all the way through the flow plate 302, the flow plate may function as a second spacer plate with the grooves defining the flow channels 312 between the flow plate and the spacer plate 306.

As illustrated, the protrusions 314 may each define a diamond shape (e.g., parallelogram shape) in some embodiments. The protrusions 314 may be separated from one another and positioned in a pattern, as illustrated, which may create turbulence in the flow through the flow channels 312. The diamond/parallelogram shape of the protrusions 314 may also assist in creating turbulence by intermixing the flow channels 312. However, the flow channels 312 and the protrusions 314 may define other shapes and/or positions in other embodiments.

The flow channels 312 may be interconnected such that for each of a plurality of intermediate positions along the flow channels, a plurality of flow paths may be defined. For example, as illustrated in FIG. 3B, a flow path 316 may begin at the entrance to one of the flow channels 312. The flow path 316 may continue to an intermediate position 318A along the flow channel 312 at which the flow may divide as a result of a protrusion 314 being positioned in the flow channel. Thus, the flow paths 316 may continue to an intermediate position 318B and an intermediate position 318C.

As noted above, it may be possible for blockages to occur in heat exchangers. In this regard, a blockage 320 is illustrated in one of the flow channels 312 between the intermediate position 318C and an intermediate position 318D. However, as a result of providing a plurality of flow paths 316 at each intermediate position, flow may travel around the blockage 320 such that only the portion of the flow channel 312 between intermediate position 318C and an intermediate position 318D does not receive flow. For example, a flow path 316 may extend from intermediate position 318B to intermediate position 318D such that intermediate position 318D receives flow despite the obstruction 320. Accordingly, by providing a plurality of flow paths at a plurality of intermediate positions along the flow channels, the loss in flow from a blockage may be significantly reduced, as compared to prior art embodiments of plate assemblies wherein the flow channels are segregated, and hence a blockage may prevent flow through substantially the entire flow channel. In some embodiments, the heat exchanger of the present disclosure may be characterized as comprising a plurality of flow channels that are each multiply branched.

Figures 4A, 4B, 4C:
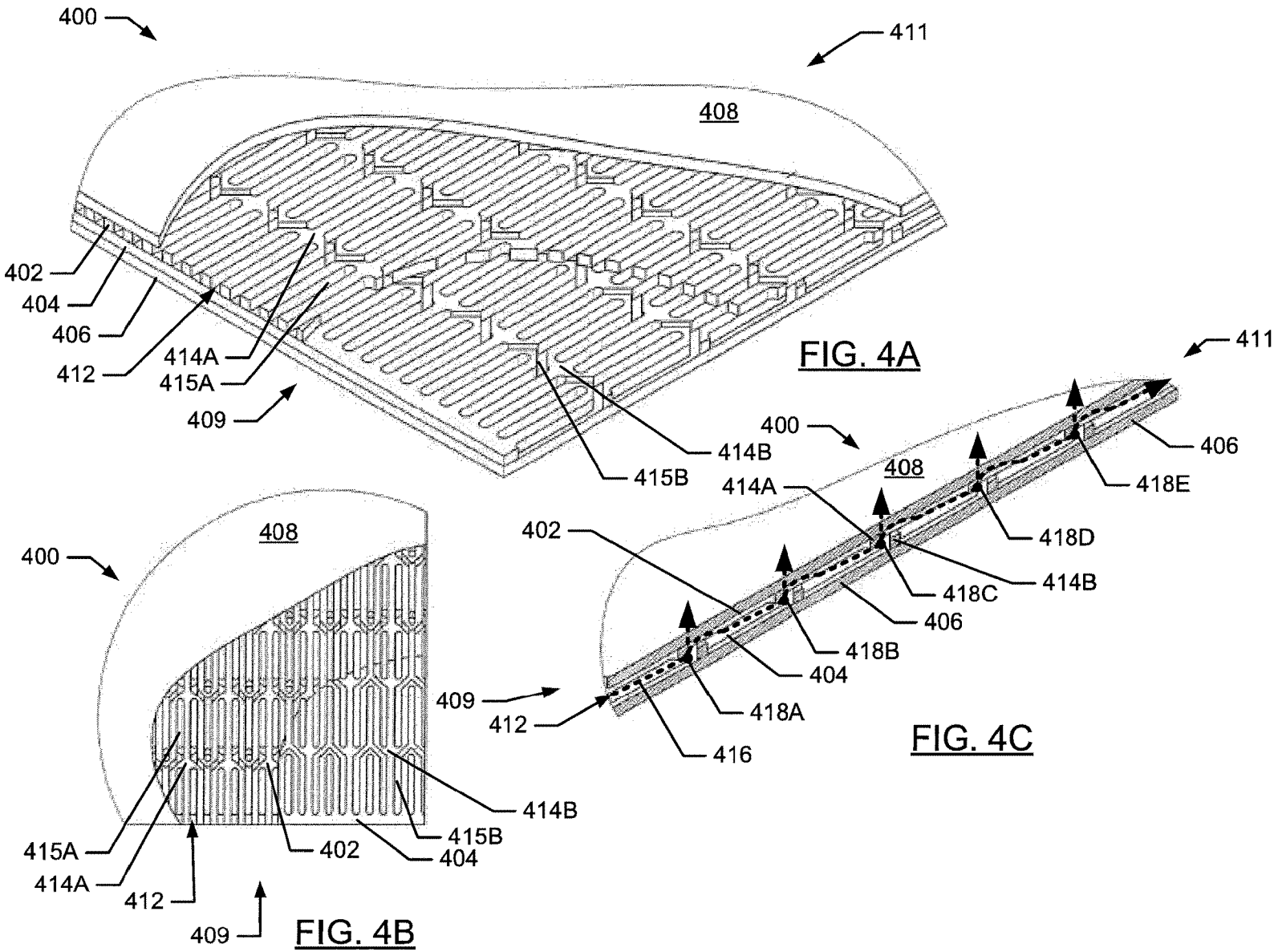
FIG. 4A illustrates a partially cutaway perspective view through a plate assembly including two flow plates with protrusions and orifices defined therein that create flow channels with multiple flow paths at intermediate positions along the flow channels, according to one example embodiment of the present disclosure.
FIG. 4B illustrates a top partially cutaway view through the plate assembly of FIG. 4A.
FIG. 4C illustrates a side sectional view through the plate assembly of FIG. 4A.

FIGS. 4A-C illustrate a plate assembly of a heat exchanger according to an alternate embodiment of the disclosure. As illustrated in FIGS. 4A-C, the plate assembly 400 may include first 402 and second 404 flow plates that are sandwiched between spacer plates 406, 408. The spacer plates 406, 408 may separate the plate assembly 400 from adjacent plate assemblies. The flow plates 402, 404 may function to create flow channels 412 through which a fluid may flow from an inlet end 409 to an outlet end 411.

As illustrated, the flow plates 402, 404 may respectively define protrusions 414A, 414B and orifices 415A, 415B. In some embodiments the protrusions 414A, 414B may define interconnected fork-shaped elements each defining a handle portion and three prongs extending therefrom. The handle portion of each protrusion 414A, 414B may define the center prong of an interconnected protrusion. Further, the protrusions 414A, 414B may be positioned such that the protrusions 414A of the first flow plate 402 extend in a first direction, and the protrusions 414B of the second flow plate 404 extend in a second direction, which is opposite to the first direction. As illustrated in FIG. 4C, this configuration may cause the flow channels 412 to define a plurality of flow paths 416 for each of a plurality of intermediate positions 418A-E along the flow channels. In this regard, fluid may flow over or around the protrusions 414A, 414B and/or through the orifices 415A, 415B, which may create turbulence. The orifices 415A, 415B of the flow plates 402, 404 may partially overlap to allow flow therethrough. Further, as discussed above, in an instance in which a blockage occurs in a flow channel 412, the flow may divert around the blockage through one or more alternate flow paths such that only a relatively small area of the flow channel including the blockage losses flow therethrough.

The plate assemblies 300, 400 disclosed herein may be employed in a variety of different embodiments of heat exchangers. The heat exchangers may be formed by brazing or diffusion bonding the plates together to create the plate assemblies in some embodiments. Accordingly, monolithic heat exchangers may be created, which may be attached via manifolds to form even larger heat exchanger devices. However, the plate assemblies may be configured to define various other embodiments of heat exchangers.

Figure 5:
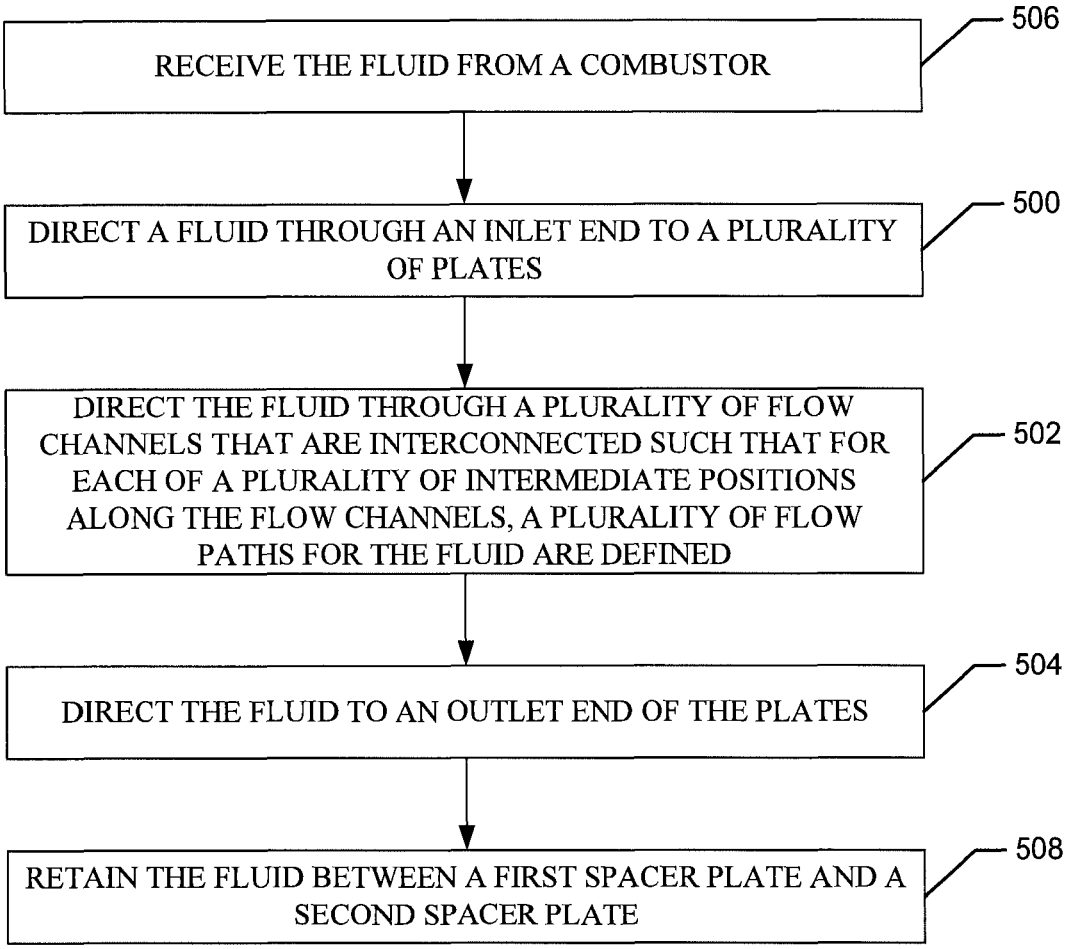
FIG. 5 illustrates a method for resisting blockage in a heat exchanger according to an example embodiment of the present disclosure.

A method for resisting blockage in a heat exchanger is also provided. As illustrated in FIG. 5, the method may include directing a fluid through an inlet end to a plurality of plates at operation 500. The inlet can be defined in the heat exchanger, and the plurality of plates can be positioned within the heat exchanger or otherwise define the heat exchanger. Further, the method may include directing the fluid through a plurality of flow channels that are interconnected such that for each of a plurality of intermediate positions along the flow channels, a plurality of flow paths for the fluid are defined at operation 502. The method may additionally include directing the fluid to an outlet end of the plates at operation 504.

In some embodiments directing the fluid through the flow channels at operation 502 may comprise dividing the fluid into the flow paths with a plurality of protrusions. Further, directing the fluid through the flow channels at operation 502 may comprise directing the fluid between a flow plate and a spacer plate. Additionally, directing the fluid through the flow channels at operation 502 may comprise directing the fluid through a plurality of partially overlapping orifices defined in a first flow plate and a second flow plate.

As illustrated at operation 506, in some embodiments the method may further comprise receiving the fluid from a combustor. In this regard, the fluid may comprise a particulate component in some embodiments. Further, the method may include retaining the fluid between a first spacer plate and a second spacer plate at operation 508.

Many modifications and other embodiments of the inventions set forth herein will come to mind to one skilled in the art to which these inventions pertain having the benefit of the teachings presented in the foregoing descriptions. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A method for resisting blockage in a heat exchanger, comprising:

directing a fluid through an inlet end of a flow plate and a second flow plate in the heat exchanger;

directing the fluid, from the inlet end of the flow plate and the second flow plate, through a plurality of flow channels that are interconnected such that for each of a plurality of intermediate positions along the flow channels, a plurality of flow paths for the fluid are defined, the plurality of flow channels being defined by a plurality of protrusions of the flow plate contacting a plurality of protrusions of the second plate, wherein a plurality of orifices positioned between the plurality of protrusions of the flow plate overlap with a plurality of orifices positioned between the plurality of protrusions of the second flow plate, wherein each of the plurality of protrusions on the flow plate and the second flow plate are interconnected fork-shaped elements each defining a handle portion and prongs;

retaining the fluid between a first spacer plate and a second spacer plate; and directing the fluid to an outlet end of the flow plate and the second flow plate;

wherein the flow plate and the second flow plate respectively extend between the inlet end and an outlet end such that the fork-shaped elements of the flow plate extend between the inlet end and the outlet end in a first direction with the prongs facing toward either the inlet end or the outlet end, and the fork-shaped elements of the second flow plate are the same as the fork-shaped elements of the flow plate but extend between the inlet end and the outlet end in a second direction opposite the first direction with the prongs facing the other of the outlet end or the inlet end.

2. The method of claim 1, wherein directing the fluid through the flow channels comprises directing the fluid between the flow plate and the first spacer plate and the second spacer plate.

3. The method of claim 1, further comprising receiving the fluid from a combustor.

4. The method of claim 3, wherein the fluid comprises a particulate component.

5. The method of claim 1, wherein the interconnected fork-shaped elements each define three prongs extending from the handle portion.

* * * * *